US007677934B2

(12) United States Patent
Piovesan

(10) Patent No.: US 7,677,934 B2
(45) Date of Patent: Mar. 16, 2010

(54) FEMALE ELECTRICAL TERMINAL

(75) Inventor: Gianni Piovesan, Cadoneghe (IT)

(73) Assignee: Inarca S.p. A., Vigodarzere (IT)

( * ) Notice: Subject to any disclaimer, the term of this patent is extended or adjusted under 35 U.S.C. 154(b) by 19 days.

(21) Appl. No.: 12/010,334

(22) Filed: Jan. 24, 2008

(65) Prior Publication Data

US 2008/0287011 A1 Nov. 20, 2008

(30) Foreign Application Priority Data

Feb. 2, 2007 (IT) ..... PD2007A0035

(51) Int. Cl.
*H01R 4/52* (2006.01)

(52) U.S. Cl. ..... 439/818

(58) Field of Classification Search ..... 439/818, 439/819, 752, 595, 601, 625, 517
See application file for complete search history.

(56) References Cited

U.S. PATENT DOCUMENTS 2,260,323 A * 10/1941 Judisch et al. ..... 439/601
2,997,685 A * 8/1961 Anderson ..... 439/625
4,632,483 A 12/1986 Verin
5,038,199 A * 8/1991 Igarashi ..... 257/678
5,267,881 A * 12/1993 Matuzaki ..... 439/660
RE34,977 E * 6/1995 McCoy ..... 439/290
5,818,320 A * 10/1998 Matsuoka ..... 337/198
5,945,903 A * 8/1999 Reddy et al. ..... 337/197
5,997,347 A * 12/1999 Robinson et al. ..... 439/517
6,544,080 B1 4/2003 Yamamoto

FOREIGN PATENT DOCUMENTS

DE 201 04 184 U1 5/2001
EP 0 127 195 A 12/1984

* cited by examiner

*Primary Examiner*—Chandrika Prasad
(74) *Attorney, Agent, or Firm*—Modiano & Associati; Albert Josif; Daniel J. O'Byrne

(57) ABSTRACT

A female electrical terminal, comprising at least one pair of mutually opposite leaf spring laminas, which are adapted to provide an accommodation and contact region for an associated blade-like male terminal. A first lamina is provided with a protrusion for contact with the blade-like male terminal, while a second opposite lamina has an extraction-preventing tooth which is designed to be inserted with a snap action in the hole of the interposed blade-like male terminal.

8 Claims, 4 Drawing Sheets

FEMALE ELECTRICAL TERMINAL

The present invention relates to a female electrical terminal.

BACKGROUND OF THE INVENTION

Female electrical terminals provided by blanking and bending sheet metal and comprising two pairs of mutually opposite leaf spring laminas, a first pair of shorter laminas and a second pair of longer laminas, are currently known and widespread.

Such leaf spring laminas have mutually opposite protrusions which are intended for contact with an interposed blade-like male terminal and are provided on the shorter laminas and on the longer laminas so as to be offset, so as to allow soft insertion of the blade-like male terminal.

The expression "soft insertion" means that the relative force to be imparted between the female terminal and the male terminal to insert the male terminal between the leaf spring laminas of the female terminal is lower than the force that would have to be applied if the laminas had the protrusions at the same height; the offset of the protrusions on the laminas causes the two pairs of laminas to be divaricated at different times, first the pair of long laminas and then the pair of short laminas.

Further, the offset contact points produced by the different length of the two pairs of laminas ensure optimum contact between the female terminal and the blade-like male terminal, even though the female terminal is not perfectly axially aligned with the hole of the male terminal.

Known terminals have the drawback that they are easily disengageable from the male terminal, and said disengagement can be determined for example by the vibrations to which the powered device is subjected, be it an electric motor, a transformer, or any other similar device; mutual disengagement of the female terminal and of the male terminal causes the interruption of the electrical connection, leading to complete or partial failure to operate of the object on which said terminals are fitted.

SUMMARY OF THE INVENTION

The aim of the present invention is to provide a female electrical terminal which is capable of obviating the drawbacks revealed by similar known types of female terminal.

Within this aim, an object of the present invention is to provide a female electrical terminal which is capable of mating firmly with the corresponding blade-like male terminal, producing a stable and secure contact.

Another object of the present invention is to provide a female electrical terminal which can be mated with known types of blade-like male terminals.

Another object of the present invention is to provide a female electrical terminal which can be assembled by using equipment of a known type which is already in use.

Another object of the present invention is to provide a female terminal which is capable of soft insertion for the male terminal at least as much as similar known types of terminal.

Another object of the present invention is to provide a female electrical terminal which can be manufactured cheaply with known systems and technologies.

This aim and these and other objects, which will become better apparent hereinafter, are achieved by a female electrical terminal, of the type comprising at least one pair of mutually opposite leaf spring laminas, which are adapted to provide an accommodation and contact region for an associated blade-like male terminal, characterized in that a first lamina is provided with a protrusion for contact with said blade-like male terminal, while a second opposite lamina has an extraction-preventing tooth which is designed to be inserted with a snap action in a hole of said blade-like male terminal.

BRIEF DESCRIPTION OF THE DRAWINGS

Further characteristics and advantages of the invention will become better apparent from the following detailed description of three preferred but not exclusive embodiments thereof, illustrated by way of non-limiting example in the accompanying drawings, wherein.

DESCRIPTION OF THE PREFERRED EMBODIMENTS

Figure 1:
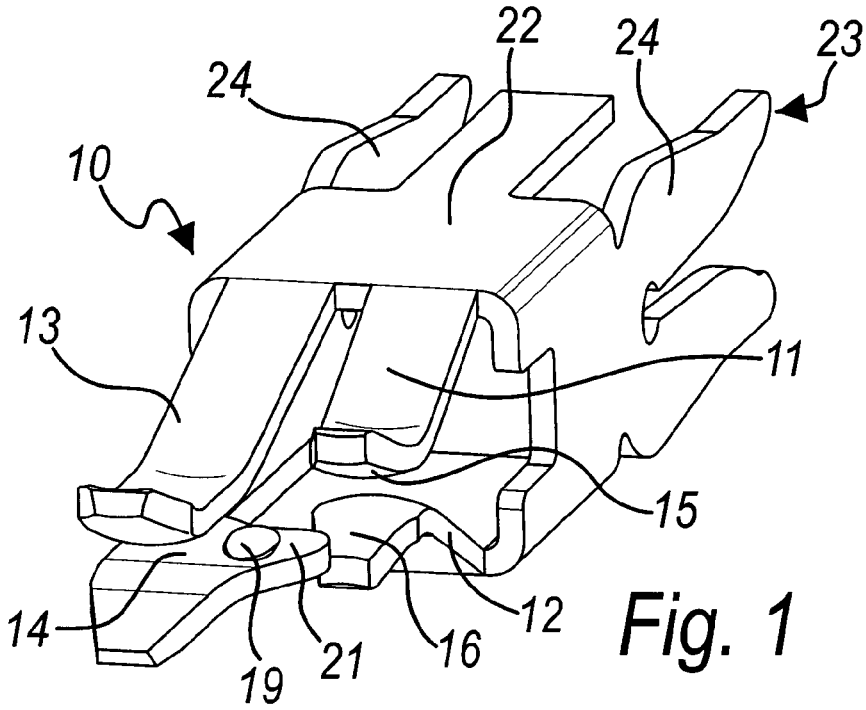
FIG. 1 is a perspective view of a terminal according to the invention in a first embodiment.
Figure 2:
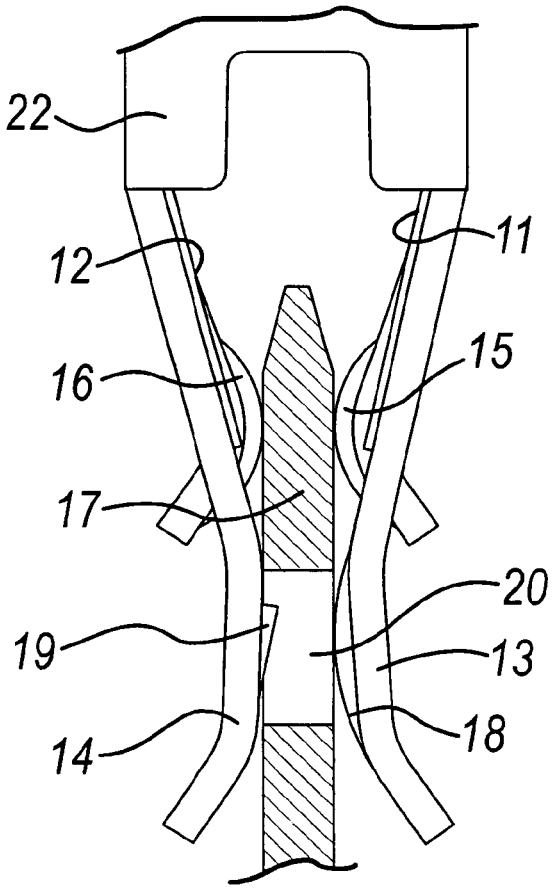
FIG. 2 is a side view of a terminal according to the invention in the first embodiment, applied to a blade-like male terminal shown in cross-section.
Figure 3:
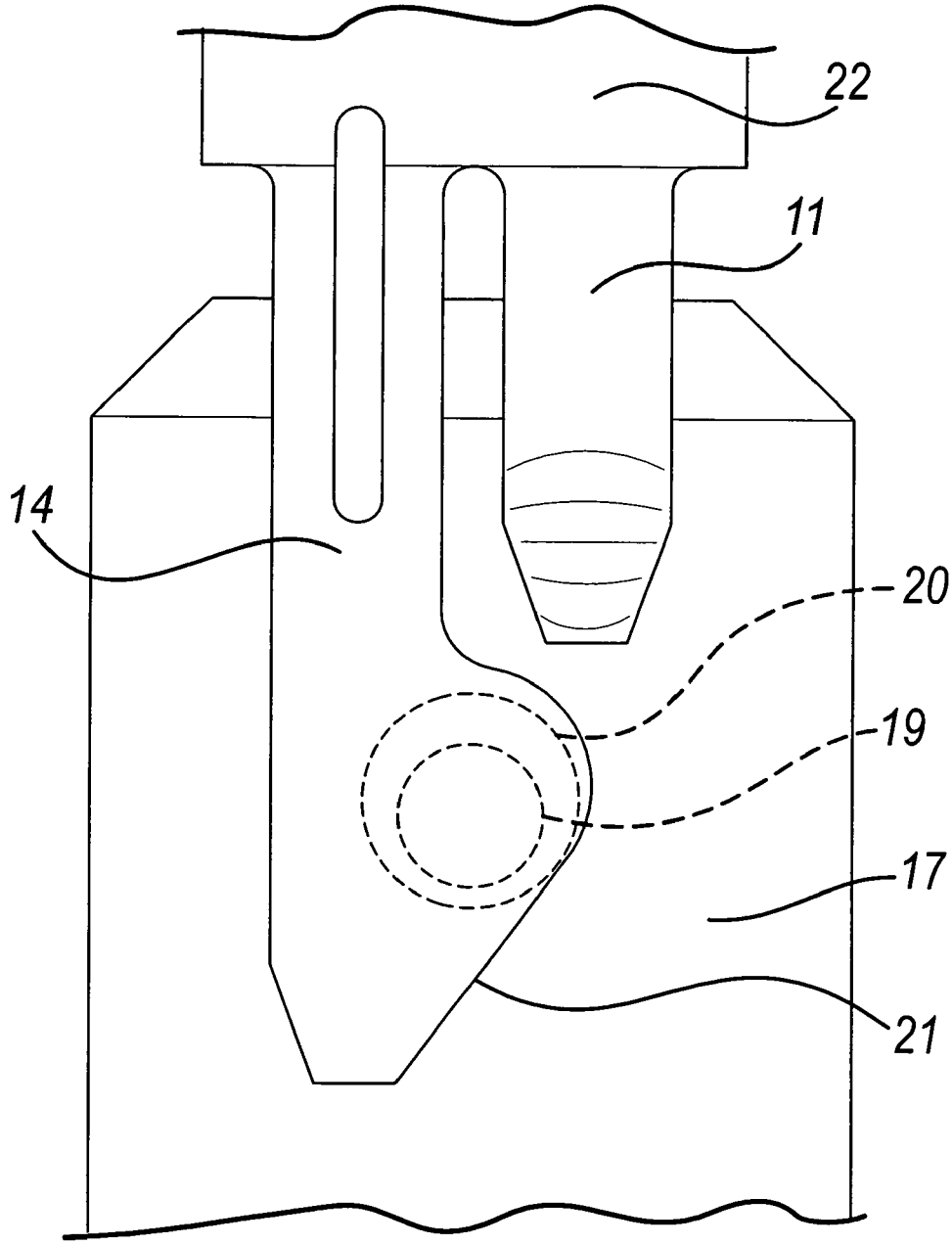
FIG. 3 is a front view of the terminal according to the invention in the first embodiment.

With reference to the figures, a female electrical terminal according to the invention is generally designated by the reference numeral 10 in its first embodiment.

The female terminal 10 is of the type provided by blanking and bending sheet metal, operations which form a body 22 provided with four leaf spring laminas 11, 12, 13 and 14 which are mutually opposite in pairs.

A first pair of shorter laminas 11 and 12 have mutually opposite protrusions 15 and 16 respectively for contact with an interposed blade-like male terminal 17.

Of the second pair of longer leaf spring laminas 13 and 14, a first long lamina 13 is provided with a protrusion 18 for contact with the blade-like male terminal 17, which is offset with respect to the protrusions 15 and 16 of the first pair of laminas 11 and 12, while the second long lamina 14 has an extraction-preventing tooth 19 which is designed to enter by snap action the hole 20 of the interposed blade-like male terminal 17.

In the embodiment of the terminal 10 described here by way of non-limiting example of the invention, the tooth 19 protrudes from a flap 21 which expands laterally from the second long lamina 14 toward the laterally adjacent short lamina 12 of the first pair of laminas 11 and 12.

The flap 21 is extended so as to affect the region of the interposed blade-like male terminal 17 in which the hole 20 is provided.

The protrusions 15 and 16 for contact of the first pair of laminas and the protrusion 18 of the long lamina 13 of the second pair of laminas with the blade-like male terminal 17 can be provided for example by studs or embossed regions.

Such protrusions determine a substantially point-like contact with the male terminal 17.

The terminal is completed by a portion 23 for connection to an electrical cable or to another means for carrying electric current; in FIG. 1, by way of example, the terminal 10 is shown with two facing forks 24 for locking an electrical cable.

The connecting portion, described here as fork like, can also be of the type with a pin, or with a blade, and it is understood that it can be a connection of any other type, shape and size, depending on requirements and needs.

Figure 5:
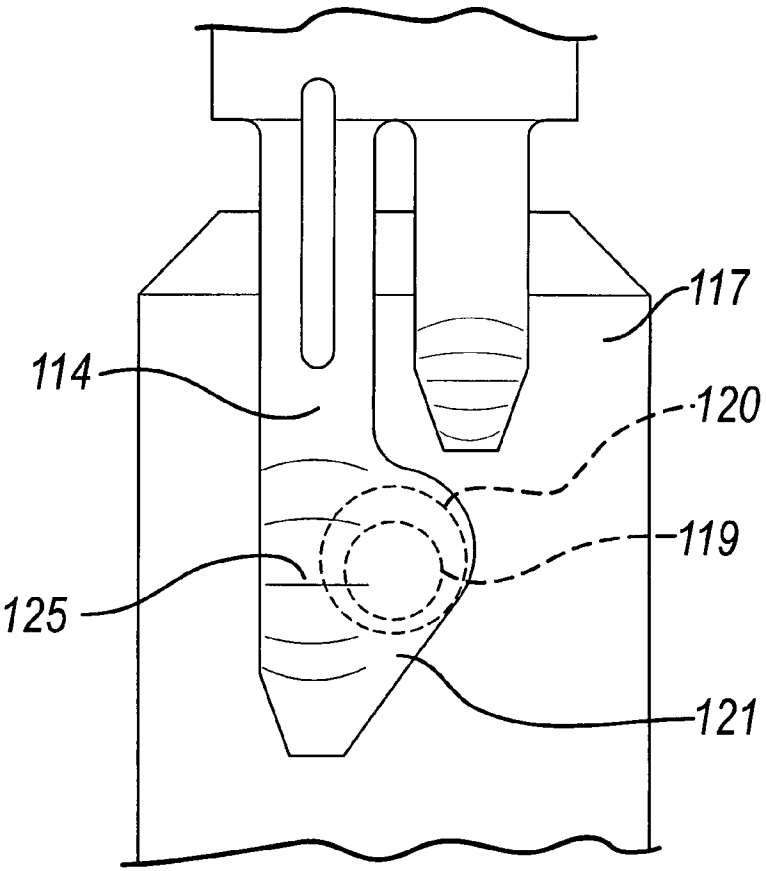
FIG. 5 is a front view of the terminal according to the invention in the second embodiment of FIG. 4.
Figure 4:
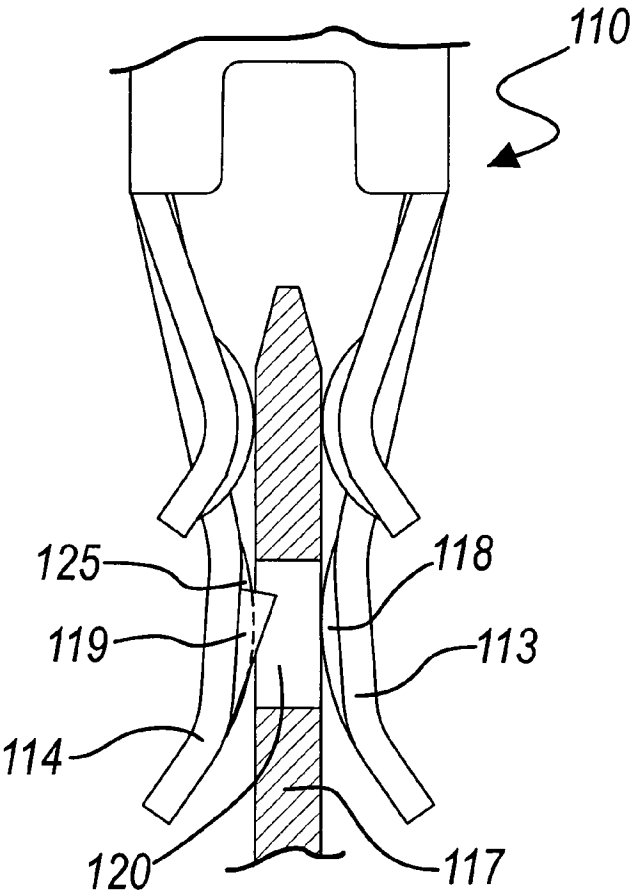
FIG. 4 is a side view of a terminal according to the invention in a second embodiment, applied to a blade-like male terminal shown in cross-section.

In a second embodiment of the terminal according to the invention, shown in FIGS. 4 and 5 and designated therein by the reference numeral 110, the long lamina 114 provided with the extraction-preventing tooth 119 has a contact protrusion 125 which lies opposite the protrusion 118 of the facing other long lamina 113.

In this case, the tooth 119 protrudes from the flap 121 more than the protrusion 125 protrudes from the lamina 114, so as to at least partly enter the hole 120 of the blade-like male terminal 117 and provide the extraction-preventing function.

Figure 6:
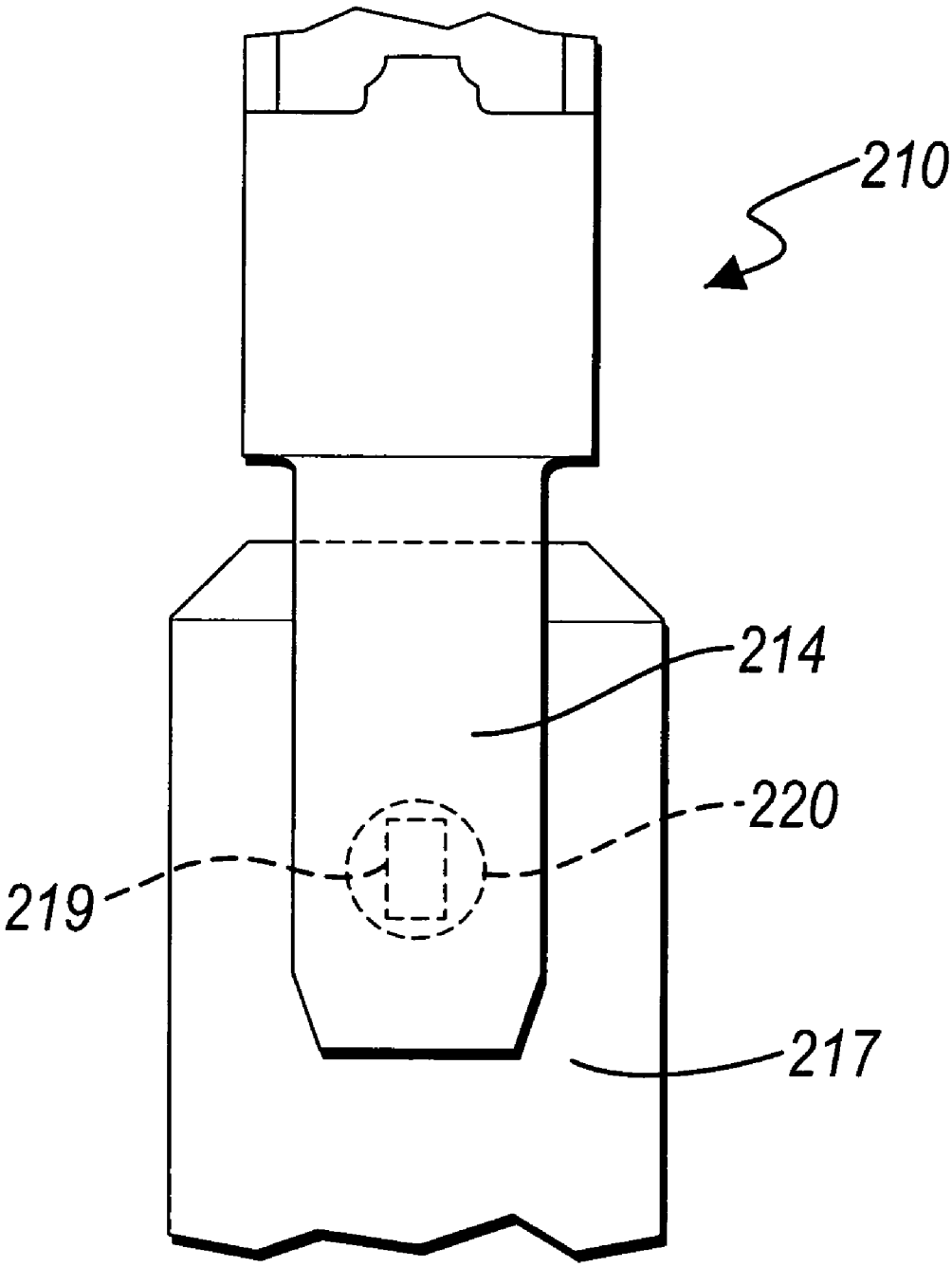
FIG. 6 is a front view of the terminal according to the invention in a third embodiment thereof.

FIG. 6 exemplifies a third embodiment of the invention, in which the terminal 210 has a single pair of mutually opposite leaf spring laminas instead of two pairs; a first lamina, not visible in the figure, is provided with a protrusion for contact with the blade-like male terminal 217, while the second opposite lamina 214 is provided with an extraction-preventing tooth 219 which is designed to enter by snap action the hole 220 of the interposed blade-like male terminal 217, in a manner similar to what has already been described above.

In practice it has been found that the invention thus described solves the problems pointed out in similar known types of female electrical terminal.

In particular, the present invention provides a female electrical terminal which mates firmly with the corresponding blade-like male terminal, providing stable and secure contact, by way of the tooth 19 and 119 which enters with a snap action the hole 20 and 120, the latter being standardized and therefore present in any blade-like male terminal 17 and 117.

Therefore, the present invention provides a female electrical terminal which can be mated with known types of blade-like male terminal.

The present invention further provides a female electrical terminal whose assembly can be provided by using known types of equipment which are already in use, since it can be provided, both as regards the body of the terminal and as regards the leaf spring laminas, with the same dimensions in terms of width, length and thickness, and with the same sectional profile, without affecting the innovative characteristics described above.

Further, the present invention provides a female electrical terminal which is capable of soft insertion for the male terminal at least as much as similar known types of terminal.

Moreover, the present invention provides a female electrical terminal which can be manufactured cheaply with known systems and technologies.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Patent Application No. PD2007A000035 from which this application claims priority are incorporated herein by reference.

What is claimed is:

1. A female electrical terminal, comprising two pairs of mutually opposite leaf spring laminas, which are adapted to provide an accommodation and contact region for an associated blade-like male terminal, said two pairs of mutually opposite leaf spring laminas comprising a first pair of shorter laminas, provided with mutually opposite contact protrusions, and a second pair of longer leaf spring laminas, which are designed to determine a contact point which is offset with respect to the contact point formed by said first pair of laminas, at least one first lamina, of said second pair of long laminas, being provided with a protrusion for contact with said blade-like male terminal, which is offset with respect to the contact protrusions of the first pair of laminas, a second one of said long laminas having an extraction-preventing tooth which is designed to enter by snap action a hole of said blade-like male terminal, said tooth protruding from a flap which widens laterally from the second long lamina toward the laterally adjacent short lamina of the first pair of laminas, so as to affect a region of the interposed blade-like male terminal in which said hole is provided.

2. The terminal of claim 1, wherein said long lamina provided with said extraction-preventing tooth has a contact protrusion which is arranged opposite the protrusion of the other facing long lamina.

3. The terminal of claim 2, wherein the tooth protrudes from the flap more than the contact protrusion protrudes from the long lamina, so as to enter at least partly the hole of the blade-like male terminal.

4. The terminal of claim 2, wherein said protrusions provide a substantially point-like contact with the blade-like male terminal.

5. The terminal of claim 2, wherein said protrusions are provided by studs or embossed regions.

6. The terminal of claim 1, further comprising a portion for connection to an electrical cable or to another means for carrying electrical current.

7. The terminal of claim 6, wherein said connecting portion is provided by two facing forks for locking an electrical cable.

8. The terminal of claim 6, wherein said connecting portion is provided by a pin-shaped output, or by a blade-shaped output, or by a connection of any other type, shape and size, depending on requirements and needs.

* * * * *